United States Patent [19]

Heller

[11] Patent Number: 4,558,857

[45] Date of Patent: Dec. 17, 1985

[54] OPERATING TABLE

[75] Inventor: Rudolf Heller, Zürich, Switzerland

[73] Assignee: Contraves AG, Zurich, Switzerland

[21] Appl. No.: 462,427

[22] Filed: Jan. 31, 1983

[30] Foreign Application Priority Data

Feb. 19, 1982 [CH] Switzerland ..... 1035/82

[51] Int. Cl.[4] ..... A61G 13/00

[52] U.S. Cl. ..... 269/325; 269/323

[58] Field of Search ..... 269/322, 323, 324, 325, 269/326; 5/62, 66, 67, 68, 69; 254/10 R, 10 C; 108/1, 3–4, 6–10

[56] References Cited

U.S. PATENT DOCUMENTS

| | | | |
|---|---|---|---|
| 2,257,491 | 9/1941 | Armstrong | 269/322 |
| 3,176,975 | 4/1965 | Burzlaff et al. | 269/325 |
| 3,281,141 | 10/1966 | Smiley et al. | 269/325 |
| 3,868,103 | 2/1975 | Pageot et al. | 269/325 |
| 4,012,031 | 3/1977 | Mitchell et al. | 269/325 |
| 4,195,829 | 4/1980 | Reser . | |

FOREIGN PATENT DOCUMENTS

| | | |
|---|---|---|
| 2260140 | 6/1974 | Fed. Rep. of Germany . |
| 2612728 | 10/1976 | Fed. Rep. of Germany . |

*Primary Examiner*—Frederick R. Schmidt

*Assistant Examiner*—Steven P. Schad

*Attorney, Agent, or Firm*—Werner W. Kleeman

[57] ABSTRACT

An operating table, particularly for microsurgery of the neck or throat, the nose or the ear of a patient comprises a vertically adjustable standard, a supporting frame, a patient rest or support structure as well as a first adjusting mechanism for performing a pivotable movement of the patient rest or support oriented transversely of the operating table and a second adjusting mechanism for performing a pivotable movement of the patient rest or support structure which is oriented longitudinally of the operating table. Both adjusting mechanisms are structured and arranged at the operating table such that, during execution of the aforementioned pivotable movements of the patient rest or support structure, an operating site or location essentially disposed within the symmetry plane of the operating table will remain largely locally in position. Working or operating cylinders acting upon the two adjusting mechanisms are accommodated or coordinated to each other in respect of their function such that the patient rest or support structure may be simultaneously pivoted in the transverse direction and the longitudinal direction of the operating table while retaining the essentially locally fixed operating site or location.

10 Claims, 11 Drawing Figures

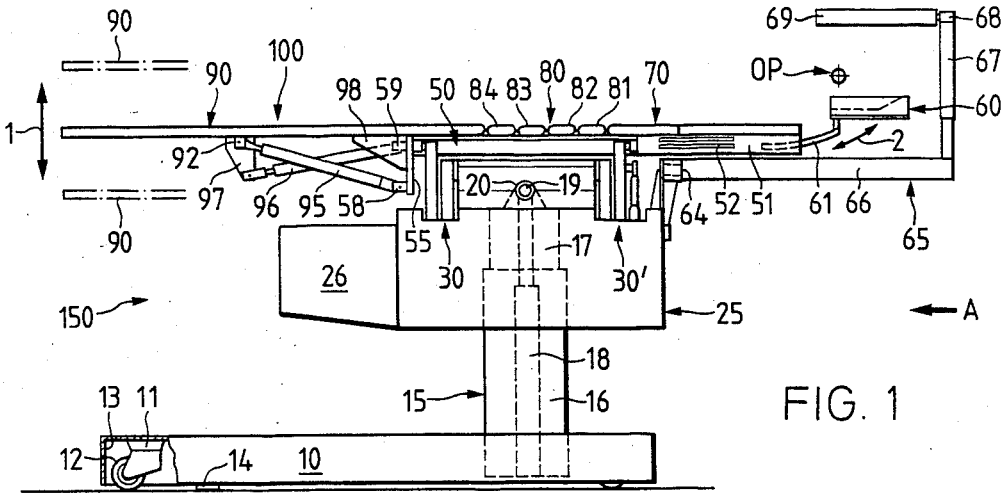
FIG. 1
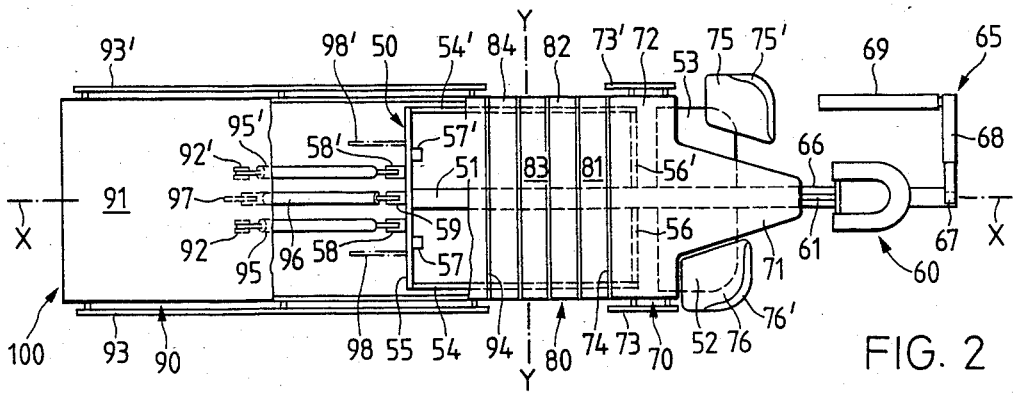
FIG. 2
FIG. 3
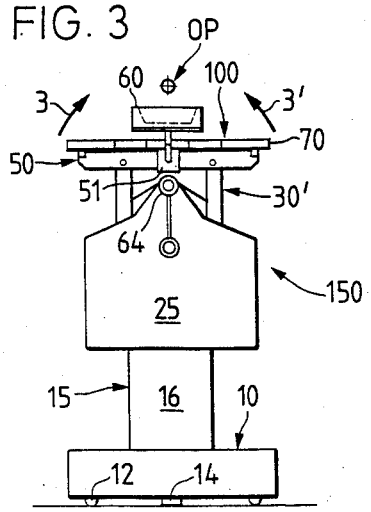
FIG. 4
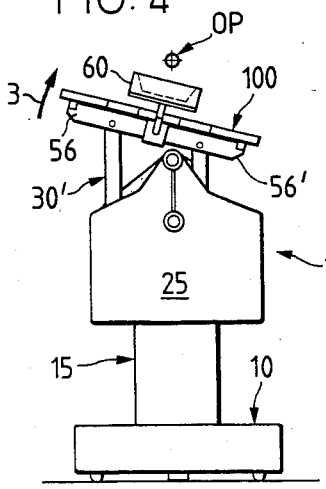
FIG. 5
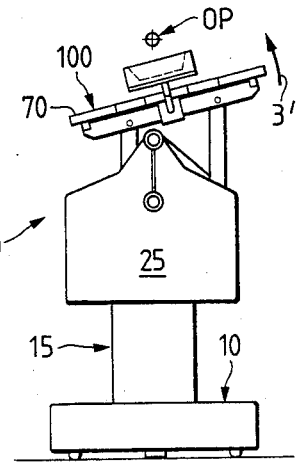

FIG. 6
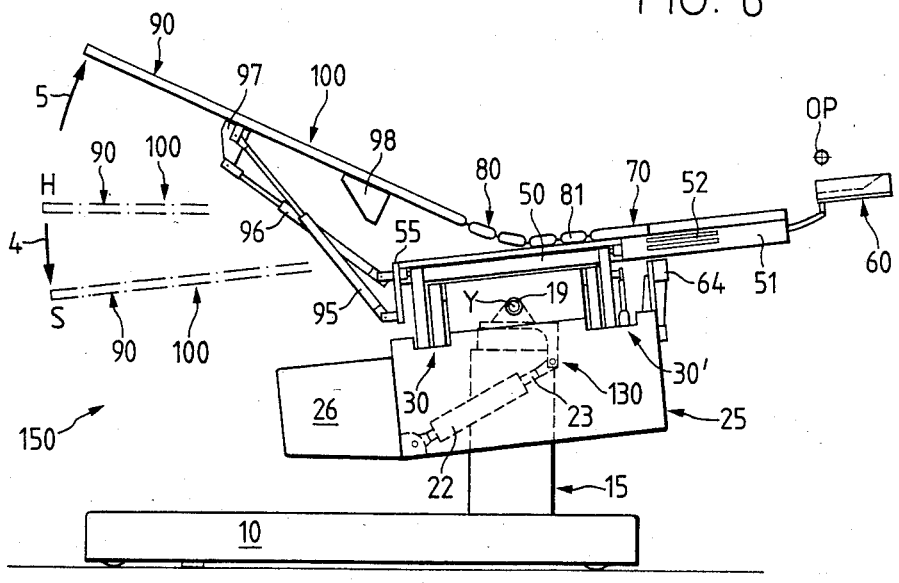
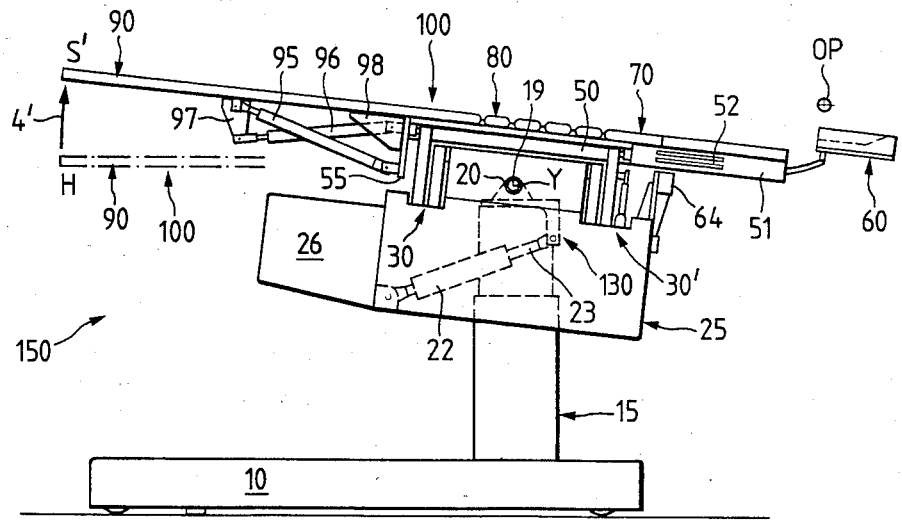
FIG. 7

OPERATING TABLE

BACKGROUND OF THE INVENTION

The present invention relates to a new and improved construction of operating table, particularly for microsurgery.

In its more particular aspects, the operating table of the present development is of the type comprising a vertically adjustable standard or column, a supporting frame, a patient rest or support structure, and first and second adjusting mechanisms or means designed to effect a pivoting movement of the patient rest or support structure which is oriented transversely and/or longitudinally with respect to the operating table.

Modern operating tables for medical purposes substantially comprise a base pedestal, a telescopically designed standard or column, and a patient rest or support structure which may be vertically adjusted with respect to the base pedestal of the standard as well as pivoted in directions oriented transversely and longitudinally of the operating table, generally by using hydraulic means. Furthermore, the patient rest or support structure may be divided into a number of elements which can be adjusted with respect to one another.

An operating table of this type is known, for example, from U.S. Pat. No. 3,281,141 and has a patient rest or support journaled on a standard or column and subdivided substantially into a headrest member, a backrest member, a pelvis rest member and a leg rest member. The individual rest or support members may be adjusted with respect to each other by means of correspondingly arranged hydraulic working cylinders, in order to attain a raised pelvis position (Trendelenburg-position), on the one hand, and may be vertically or elevationally adjusted with respect to the base pedestal by means of a lifting cylinder appropriately arranged within the standard, on the other hand. Furthermore, the patient rest or support structure which is carried by a frame is pivotable with respect to the standard about a bolt oriented in the longitudinal direction of the operating table. The pivoting movement is limited by two lateral sheet metal members arranged at a distance from the standard and mounted to the frame, the lateral sheet metal members forming a component of the pivoting mechanism or means.

SUMMARY OF THE INVENTION

Therefore, with the foregoing in mind it is a primary object of the present invention to provide and improved construction of an operating table, particularly an operating table for microsurgery which is constructed in such a manner that an operating spot or location defined at the region of a patient may be changed in its orientation for performing the diagnosis and surgery, without requiring a change in the fixed working position of the surgeon.

Another important object of the present invention aims at the provision of a new and improved construction of operating table of the aforementioned type which permits a change in the orientation of the operating location or spot located at the region of a patient for performing the diagnosis and surgery, without requiring a substantial change in the position of an operating or surgical microscope which is fixedly aligned at the operating location or spot.

Still a further noteworthy object of the invention is the provision of an improved construction of an operating table which enables selectively shifting the position of the patient while essentially retaining fixed in space the position of a site of an operating location or field.

Now in order to implement these and still further objects of the invention, which will become more readily apparent as the description proceeds, the operating table of the present development is manifested by the features that, the patient rest or support structure is pivotable about the operating location or site which is disposed substantially within the symmetry plane of the operating table, and the first and second adjusting mechanisms or means are constructed and arranged at the operating table so as to essentially maintain the location of the operating location or site largely locally unchanged, when the pivoting movements are carried out.

According to a further feature of the operating table according to the invention, the patient rest or support structure comprises a headrest member, a backrest member, a pelvis rest member, and a leg rest member which can be readily adapted to the size or dimensions of the patient. The pelvis rest member comprises a number of lamellae or plates or the like articulated to each other and may be conjointly lifted with the leg rest member with respect to the backrest member which is secured to the supporting frame.

Furthermore, shoulder rest or support members are arranged to each side of the backrest member of the patient rest or support structure. The shoulder rest members are structured for individual or separate adjustment. This separate adjustability permits inclinedly positioning the patient upon the operating table in case of operations at difficulty accessible operating locations or sites, in order to be able to fix the surgery or operating location or site within the symmetry plane of the operating table, so that the working area or region available to the surgeon is not restricted.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a perspective side view of the operating table constructed according to the invention;

FIG. 2 is a top plan view of the operating table shown in FIG. 1;

FIG. 3 is an end view, looking in the direction of the arrow A in FIG. 1, of the operating table shown in FIG. 1;

FIG. 4 is an end view of the operating table as shown in FIG. 3 with the patient rest or support structure pivoted to one side thereof about an operating site or location located on the longitudinal axis X—X of the operating table;

FIG. 5 is an end view of the operating table as shown in FIG. 3 with the patient rest or support structure pivoted to the other side about the operating site or location;

FIG. 6 is a side view of the operating table shown in FIG. 1 depicting a first pivoted position of the patient rest or support structure pivoted about the operating site or location disposed substantially within the symmetry plane of the operating table;

FIG. 7 is an end view of the operating table shown in FIG. 6 depicted in a second pivoted position;

DETAILED DESCRIPTION OF THE PREFERRED EMBODIMENTS

Figure 8:
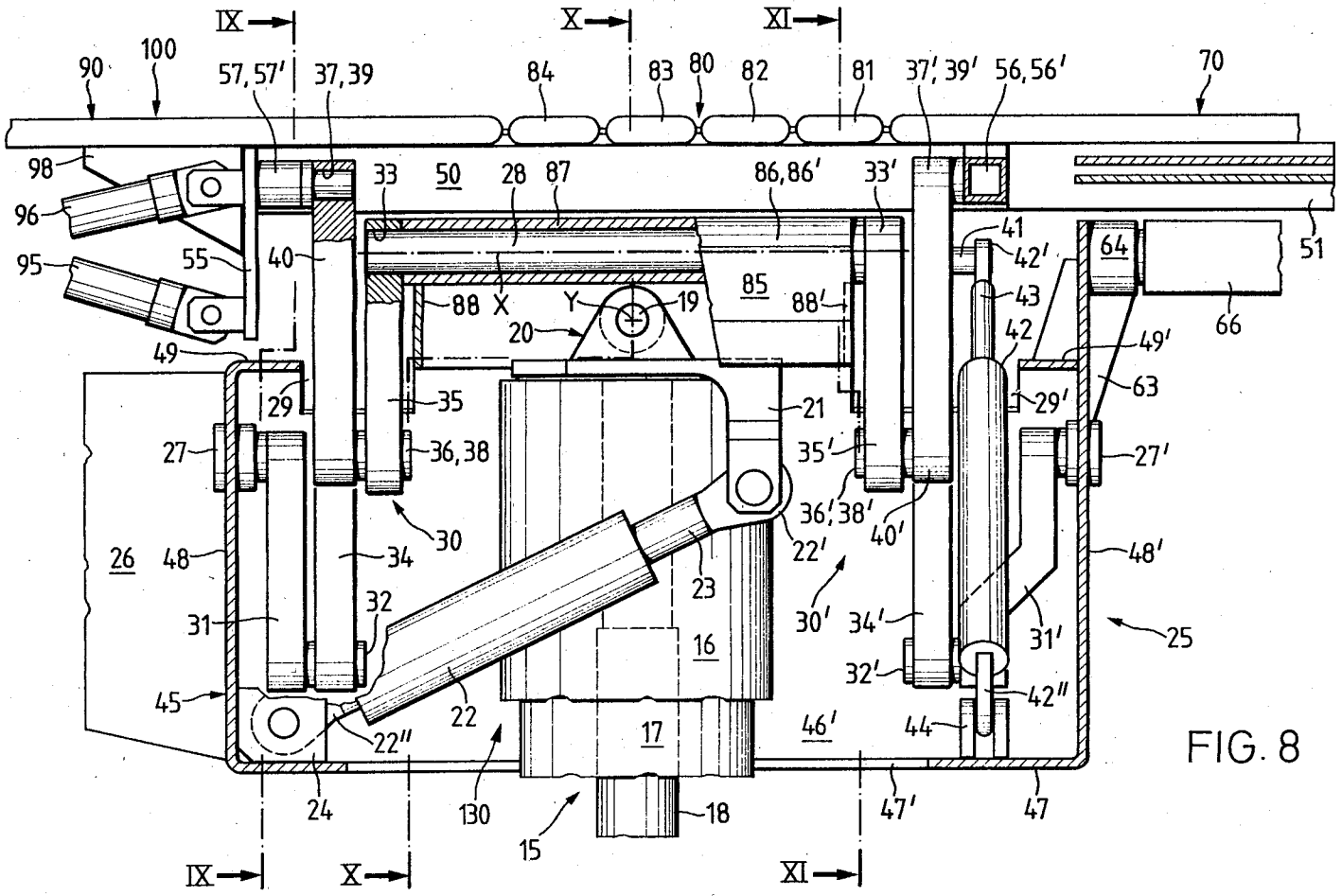
FIG. 8 is a sectional view on an enlarged scale of the first and second adjusting or adjustment mechanisms for the patient rest or support structure of the operating table shown in FIG. 1.

Describing now the drawings, it is to be understood that in order to simplify the illustration thereof only enough of the construction of the operating table has been shown as needed for those skilled in the art to readily understand the underlying principles and concepts of the present invention. Turning now specifically to FIGS. 1 and 2 of the drawings, which depict an exemplary embodiment of operating table 150 in side view and in top plan view, respectively, such operating table 150 will be seen to comprise a base pedestal or frame 10, a standard or upright column 15, a support or support element 25, a supporting frame 50, and a patient rest or support structure 100. For the local or positional displacement of the operating table 150 casters or rollers 12 are provided and correspondingly arranged at the base pedestal 10, which is illustrated partially in section, each of these rollers 12 being mounted in a related bearing block 11 located at the inner side 13 of the base pedestal 10. The operating table 150 may be fixed at the intended location by any suitable locking or fixing means 14 arranged at the bae pedestal 10, and thus, such locking means have merely been schematically shown. A housing 26, which is likewise illustrated schematically, is mounted to one side of the support 25, and a suitable electric motor and pump are located therein for appropriately powering the operating table 150.

The upright column or standard 15 includes a stand pipe or upright 16 which is mounted at one side thereof in the base pedestal 10 in any suitable manner. The standard 15 further includes a tube 17 telescoped into the stand pipe 16 and guided therein for axial displacement as well as a lifting cylinder 18 centered within the standard 15. The lifting cylinder 18 serves for the vertical adjustment of the patient rest or support structure 100 in the direction of the double-headed arrow 1 and is supported at one end at the base pedestal 10 or within the stand pipe 16. With its other end, this lifting cylinder 18 is appropriately mounted at a main bearing 20 arranged at the upper end of the telescopic tube or pipe 17. The housing-like support 25 and the main or primary bearing 20 are operatively interconnected by a bolt 19 which piercingly extends through these two members 20 and 25 and which substantially forms the transverse or crosswise axis Y—Y of the operating table 150. First respective adjusting or adjustment means 30, 30′ are arranged in the support 25 to both sides of the standard 15. As will be explained in detail hereinafter, each of the adjusting means or mechanisms 30, 30′ is formed by a number of links or linking levers and pivotal levers which are articulated to each other and by a number of working cylinders. The adjusting means or mechanisms 30, 30′ are mounted at the support 25 on one side thereof and are operatively connected to the supporting frame 50 for the patient rest or support structure 100 on the other side thereof.

As shown in FIG. 2, guiding or guide elements 52 and 53 are arranged to opposite sides of a longitudinal support or bar 51 at the front region of the supporting frame 50. As also will be recognized from FIG. 1, the individual guiding or guide elements 52 and 53 comprise two sheet metal or panel members or the like which are arranged in spaced relationship from each other and intermediate which there is disposed a respective one of the schematically illustrated shoulder rest or support members 75 and 76. The shoulder rest members 75 and 76 are each conveniently adjustable in a substantially horizontal plane and are mounted so as to be appropriately locked in position by any suitable locking or fixing means which have not been particularly illustrated. In FIG. 2, the one shoulder rest member 75 provided with a lateral support member 75′ has been illustrated in its maximum extended position, whereas the other shoulder rest member 76 provided with a lateral supporting member 76′ has been shown in its minimum non-extended position i.e., in its maximum retracted position.

At the front end of the operating table 150 there is disposed a headrest or head support member 60 which is retained by an arcuately configured guiding or guide member 61 mounted at the longitudinal support or bar 51 of the supporting frame 50. Furthermore, the headrest member 60 may be continuously or infinitely adjusted in the direction of the double-headed arrow 2 by means of a not particularly shown working or operating cylinder arranged within the longitudinal support or bar 51.

Additionally, a schematically illustrated arm rest or support 65 is arranged at the front end of the operating table 150. This arm rest 65 comprises a support or beam 66, a telescopic bracket 67 mounted to the front end of the support or beam 66, a telescopic cantilever 68 journaled at the bracket 67, and an armrest member 69 arranged at the cantilever 68. As likewise illustrated in FIG. 1, the support or beam 66 is arranged in a bearing 64 at the support 25 and is fixedly mounted thereat by any suitable fixing means. The armrest member 69, on the one hand, may be vertically adjusted by means of the telescope-like designed bracket 67 and may be adjusted with reference to the longitudinal axis X—X of the operating table 150, on the other hand, by means of the telescope-like designed cantilever 68.

For better representation a portion of the patient rest or support structure 100 is partially shown broken away in FIG. 2. There will be recognized the supporting frame 50 comprising the longitudinal support or bar 51, two profiled supports or beams 54 and 54′ arranged in parallel spaced relationship therefrom, two cross beams or traverses 56 and 56′ and an end sheet metal or panel member 55, to one side of which the longitudinal support or bar 51 is appropriately secured. At the other side of the end sheet metal member 55 there are attached the schematically illustrated bearing elements 58, 58′ and 59 arranged at a distance from each other.

The patient rest or support structure 100 supported at the supporting frame 50, as has been illustrated in FIG. 1 and FIG. 2 is designed, in the embodiment shown, so as to essentially comprise three members, and specifically, encompasses a backrest or back support member 70, a seat or pelvis rest or support member 80, and a leg rest or leg support member 90. The support members 70, 80 and 90 of the patient rest or support structure 100 are individually described in greater detail hereinafter:

As will be evident particularly from FIG. 2, the backrest or back support member 70 comprises a first portion 72 and a substantially conically configured second portion 71 which is located at the side facing the headrest member 60. The inclination of the second portion 71 corresponds to the inclination of the associated shoulder rest or support members 75 and 76. The resting or support surface of the backrest member 70 is variably adjustable at the region of the conical second portion 71 in accordance with the shoulder width of the patient by means of the two shoulder rest members 75 and 76. At the side facing the pelvis rest or support member 80 the first portion 72 is designed as a bearing element 74. Additionally, removable lateral rails or guards 73, 73' are arranged at the first portion 72, which only have been shown in FIG. 2 for better clarity. The backrest member 70 is mounted at the supporting frame 50 by any suitable mounting means.

The seat or pelvis rest member 80 reposes substantially loosely upon the supporting frame 50 and comprises a number of lamellae or relatively narrow plates 81, 82, 83 and 84 articulated to each other, the lamella or plate 81 being linked to the bearing element 74 of the backrest member 70 and the lamella or plate 84 being linked to a correspondingly designed bearing element 94 of the leg rest or leg support member 90.

The leg rest member 90 formed by conventional substantially longitudinally and transversely extending bars or beams and by a support or resting plate 91, which is shown in FIG. 2 partially broken away, contains two bearing blocks 92 and 92' arranged at the underside of the support or resting plate 91 at a distance from each other, two supporting sheet metal or panel members 98 and 98' arranged at a distance from each other and engaging the end sheet metal member 55 of the supporting frame 50 (FIG. 1) as well as a bearing block 97. The two bearing blocks 92 and 92' correspond to the bearing blocks 58 and 58' arranged at the end sheet metal member 55 and serve to journal or mount lifting or displacement cylinders 95 and 95'. The bearing block 97 corresponds to the bearing block 59 arranged at the end sheet metal member 55 and serves to journal or mount a further lifting or displacement cylinder 96. Furthermore, removable lateral rails or guards 93, 93' are arranged at the leg rest or leg support member 90 which are only shown in FIG. 2 for better clarity.

FIG. 3 shows the operating table 150 in an end view looking in the direction of the arrow A in FIG. 1. There will be recognized the base pedestal 10 resting upon the floor by means of the rollers or casters 12, the standard or upright support column 15 including the stand tube or pipe 16, the support 25, a portion of the first adjusting means 30, 30', the support or supporting frame 50 operatively connected to the adjusting means, the headrest member 60 mounted in the longitudinal support or bar 51 as well as the backrest member 70 of the patient rest or support structure 100. The arm rest 65 arranged in the bearing 64 by means of the support or beam 66 as well as the shoulder rest members 75, 76 journaled at the guiding or guide elements 52 and 53, respectively, arranged at the supporting frame 50, are not shown in FIG. 3.

By means of the first adjusting means or mechanism 30, 30' arranged within the support 25 and by means of appropriate operatively associated working or operating cylinders, still to be described in greater detail hereinafter, the patient rest or support structure 100 formed by the members 70, 80 and 90 is pivotable together with the supporting frame 50 about an operating location or spot OP—the operating site—located on the longitudinal or symmetry axis X—X of the operating table 150 by a parallel displacement of the first adjusting means 30, 30' in the direction of the arrow 3 or 3', respectively. FIGS. 4 and 5 show an end view of the operating table 150 as shown in FIG. 3; FIG. 4 illustrates the position with the patient rest or support structure 100 pivoted in the direction of the arrow 3, and FIG. 5 shows the position with the patient rest or support structure 100 pivoted in the direction of the arrow 3'.

FIG. 6 shows the operating table 150 (the shoulder rest members 75, 76 not being shown) depicted in FIG. 1 in a side view and in a first position, and FIG. 7 shows the same operating table in a second position. In the first position the patient rest or support structure 100 has been pivoted about the operating location or site OP disposed substantially within the symmetry plane of the operating table 150 from the dash-dotted essentially horizontal position H in the direction of the arrow 4 into the downwardly inclined position S which slopes downwardly from the front towards the rear of the operating table 150. In the second position of FIG. 7, the patient rest or support structure 100 has been pivoted about the operating location or site OP disposed substantially within the symmetry plane of the operating table 150 from the dash-dotted horizontal position H in the direction of the arrow 4' into the downwardly inclined position S' which slopes downwardly from the rear towards the front of the operating table 150. The pivotal movements of the patient rest 100 in the direction of the arrows 4 and 4' as well as of the members operatively connected thereto, namely, the support 25, the first adjusting means or mechanism 30, 30' and the supporting frame 50, is accomplished by means of a second adjusting means 130 embodying a piston-cylinder unit 22, 23 schematically illustrated in FIGS. 6 and 7. On the side of the piston, the piston-cylinder unit 22, 23 is suitably mounted at the main bearing 20 and on the cylinder side at the support 25.

If desired, the leg rest or leg support member 90 and, in part, the seat or pelvis rest or support member 80 formed by the individual lamellae or plates 81, 82, 83, 84 which adapt to the body size of the patient and which are articulated to each other, may be lifted relative to the backrest or back support member 70 mounted at the supporting frame 50. The raising or lifting of the leg rest member 90 and the seat or pelvis rest member 80 from the dash-dotted position into the bent-off or angled position is designated in FIG. 6 by the directional arrow 5. This movement occurs substantially in two phases and may be executed independently of the momentary position of the patient rest or support structure 100. During the first phase of the movement the leg rest member 90 is raised together with the seat or pelvis rest member 80 formed by the individual lamellae or plates 81, 82 83, 84 by means of the lifting or displacement cylinder 96. The maximum bent-off or angled position is reached when the lamella or plate 81 linked to the backrest member 70 is lifted from the supporting frame 50. The lifting of the leg rest member 90 together with the seat or pelvis rest member 80 is advantageous for medical reasons in case of protracted operations and, additionally, serves to stabilize the position of the patient reposing upon the patient rest or support structure 100.

In the position of the patient rest or support structure 100 illustrated in FIGS. 1 and 7, the members 80 and 90 are not lifted and the leg rest member 90 is supported at the end sheet metal member 55 of the supporting frame 50 by the supporting sheet metal members 98 and 98' mounted at the underside thereof.

FIG. 8 shows on an enlarged scale and in sectional view the support 25 including the first and second adjusting or adjustment means 30, 30' and 130, respectively. There will be recognized the lifting or displacement cylinder 18 centered within the standard 15 substantially formed by the stand tube or pipe 16 and by the telescoped or telescopic tube 17 which is provided for the vertical adjustment of the patient rest or support structure 100 as indicated in FIG. 1 by the directional double-headed arrow 1. Furthermore, the piston-cylinder unit 22, 23 for pivotally moving the patient rest or support structure 100 about the operating location or site OP likewise will be recognized, which, on the cylinder side thereof, is journaled by a pivoting part 22" in a bearing block 24 arranged at and secured to the support 25 and, on the piston side thereof, is mounted by a pivoting part 22' at a lug or bracket 21 of the main bearing 20.

The support 25 comprises a first housing member 45 and a second housing member 85. The first housing member 45 comprises an end wall 48, a rear or back wall 48', two side walls 46 and 46', an upper bottom member 49 and 49' as well as a lower bottom member 47 in which, for attaining the pivotal movement of the support 25 relative to the elevationally adjustable standard 15, as shown in FIGS. 6 and 7, there is provided a correspondingly dimensioned recess 47'. The second housing member 85 of the support 25 is arranged at a distance from the end wall 48 and from the rear wall 48' in the direction of the longitudinal axis X—X of the operating table 150 and comprises two side walls 86 and 86', a bearing element 87, an end wall 88 as well as a rear wall 88'. The two side walls 86 and 86' are contiguous or merge with the two side walls 46 and 46', respectively, of the first housing member 45, as shown in greater detail in FIG. 11. At the upper region, the side walls 86 and 86' are secured to the bearing element 87. The end wall 88 and the rear wall 88' are structured in accordance with the shape of the second housing member 85 and are mounted to the side walls 86 and 86'. The bearing element 87 is piercingly penetrated by a bolt member 28 or the like which substantially forms the longitudinal axis X—X of the operating table 150. At both of its ends this bolt or bolt member 28 is designed as a journal or bearing 33 and 33' for two connecting elements 35 and 35', respectively, of the first adjusting means or mechanism 30, 30', and which connecting elements 35 and 35' are operatively connected to the bolt 28. The first adjusting means or mechanism 30, 30' is linked to the bolt 28, to the supporting frame 50 and the to the first housing member 45 and, as will be evident from FIG. 8, are arranged in corresponding recesses 29 and 29', respectively, which are designed and dimensioned to accommodate the pivotal movements, designated by the directional arrows 3 and 3' in FIG. 3, of the corresponding members.

The first adjusting or adjustment means 30, 30' encompass both the connecting or connection elements 35, 35', two first parallel links or guides 40, 40', two second parallel links or guides 34, 34' as well as two pivoting or pivotal levers 31, 31'. Each individual connecting element 35 or 35' is rigidly connected for rotation at the bolt 28 by means of the bearing 33 or 33', respectively, shown partially in section on one side in the case of the bearing 33. At the other end, each connecting or connection element 35 or 35' has two pivot or rotary bearings 36, 38 or 36', 38', respectively, which are spaced apart from one another. The first parallel link or guide 40 is journaled at one end thereof to the pivot bearing 38 of the connecting element 35, and at the other end thereof, which is partially illustrated in section and which is designed as a pivot bearing 39, such first parallel link or guide 40 is mounted at a bearing element 57. The second parallel link or guide 34 is journalled at one end thereof at a pivot bearing 32 of the related pivoting or pivotal lever 31, and, is journaled at a central portion thereof at the pivot bearing 36 of the connecting element 35, while the other end thereof, designed as a pivot bearing 37, is mounted at a bearing element 57'. Both the bearing elements 57 and 57' for the parallel links or guides 40 and 34, respectively, are arranged at a distance from each other in the transverse direction of the operating table 150 and are appropriately secured to the end sheet metal member 55 of the supporting frame 50. The individual pivoting or pivotal levers 31 or 31' are operatively connected at the one end which is designed as a pivot bearing 32 or 32', respectively, with the parallel link or guide 34 or 34', respectively, and are mounted at the other end thereof in a related pivot bearing 27 or 27', respectively, arranged at the end wall 48 and at the rear wall 48', respectively, of the first housing member 45.

The other parts of the first adjusting or adjustment means designated by reference numeral 30' are largely constructed like the parts of the first adjusting or adjustment means 30 described hereinbefore, and encompass the first parallel link or guide 40', the pivoting or pivotal lever 31', the second parallel link or guide 34' and the connecting or connection element 35'. Differing from the aforementioned one first adjusting means or mechanism 30, this other first adjusting means 30' is operatively connected to a piston-cylinder unit 43, 42. In the other first adjusting means or mechanism 30' the first parallel link or guide 40' is journaled at one end thereof at the pivot bearing 38' of the connecting or connection element 35', and at the other end thereof at the pivot bearing 39'. The second parallel link or guide 34' is journaled at one end thereof at the pivot bearing 32' of the pivoting or pivotal lever 31', and at the other end thereof at the pivot bearing 37'. The two pivot bearings 37' and 39' of the parallel links or guides 34' and 40', respectively, are arranged at a distance from each other and are journaled in suitable bearing elements (not shown) correspondingly arranged at the cross beams or traverses 56 and 56', respectively, of the supporting frame 50. The piston-cylinder unit 43, 42 serves to effect the pivotal or tilt movements of the patient rest or support structure 100 represented by the directional arrows 3 and 3' in FIGS. 3, 9 and 11. On the cylinder side, the piston-cylinder unit 43, 42 is mounted by means of a pivoting part 42" in a bearing block 44 secured to the bottom member 47, and on the piston side thereof is mounted by means of a pivoting part 42' in a pivot bearing 41 arranged at the second parallel link or guide 34'.

Furthermore, in FIG. 8 there will be recognized the backrest member 70 resting upon the longitudinal support or bar 51, the seat or pelvis rest member 80 formed by the lamellae or plates 81, 82, 83 and 84 which are articulated to each other, the leg rest portion or member 90 of the patient rest or support structure 100 supported by the supporting sheet metal member 98 at the end sheet metal member 55, as well as the lifting or displacement cylinders 95 and 96 mounted at the end sheet metal member 55 and at the leg rest member 90.

In a manner differing from the end wall 48 the rear wall 48' of the first housing member 45 is extended above the bottom member 49' and is constructed substantially in accordance with the shape or configuration of the second housing member 85 (FIG. 3). At the upper region of the rear wall 48' there is arranged the bearing 64 which is supported at such rear wall 48' by a gusset plate 63 or the like; the support or beam 66 of the arm rest 65 being journaled and mounted to the bearing 64 in any suitable manner.

Figure 9:
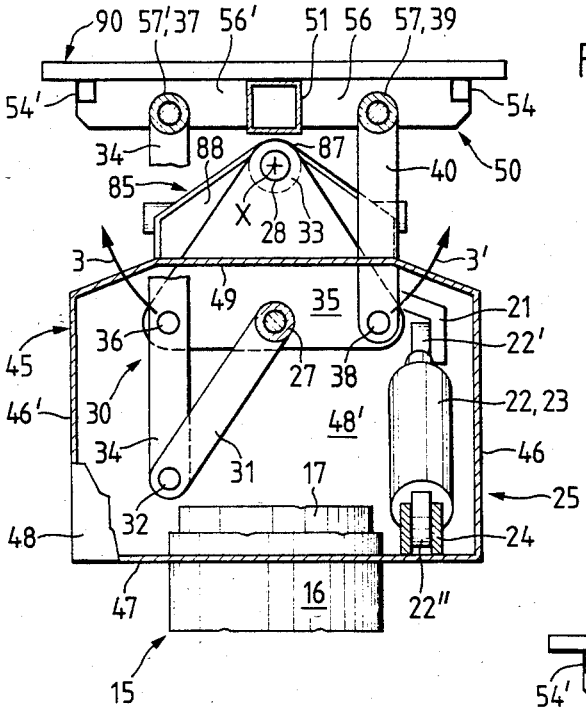
FIG. 9 is a section taken along the line IX—IX in FIG. 8 illustrating details of the first adjusting means or mechanism.

FIG. 9 shows a section substantially along the line IX—IX in FIG. 8. There will be recognized the leg rest member 90, the supporting frame 50, the first and second housing members 45, 85 of the support 25, the standard or upright column 15 including the telescoped or telescopic tube 17 and the stand tube or pipe 16, the piston-cylinder unit 23, 22 as well as the parts of the one first adjusting means or mechanism 30 arranged within the support 25. The supporting frame 50 comprises the two exterior longitudinal supports or bars 54, 54', the central longitudinal support or bar 51 as well as the two cross beams or traverses 56, 56' including the bearing elements 57 and 57' spaced from each other. Furthermore, there will be recognized the first housing member 45 composed of the side walls 46, 46', the end wall 48, the rear wall 48', the bottom member 47 and the bottom member 49' designed with a bevel or chamfer, as well as the second housing member 85 contiguous to the bottom member 49 and including the end wall 88 and the bearing 87. At the bolt or bolt member 28 disposed in the bearing 87 the connecting or connection element 35, which is designed as an equilateral triangle, is journaled for pivotal movements in the direction of the arrows 3, 3' by means of the bearing 33. For attaining such pivotal movements the first parallel link or guide 40 is linked to the bearing element 57 at the one end thereof designed as a pivot bearing 39, and at the other end thereof is linked or hinged to the pivot bearing 38 of the connecting element 35. The second parallel link or guide 34, which is linked or hinged at the central portion thereof to the pivot bearing 36 of the connecting element 35, is linked or hinged to the bearing element 57' at one end thereof designed as a pivot bearing 37 and at the other end thereof is hinged to the pivoting lever 31 containing the pivot bearing 32. The pivoting or pivotal lever 31 is thus operatively connected at one end thereof to the parallel link or guide 34, and is pivotably journaled at the other end thereof in the bearing 27 arranged at the end wall 48.

Figure 10:
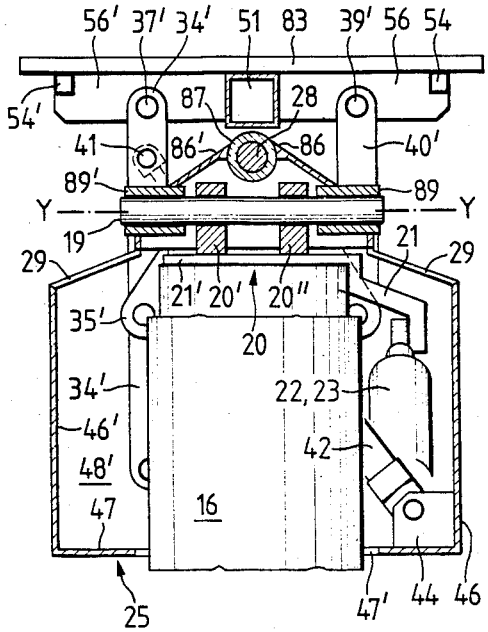
FIG. 10 is a section taken along the line X—X in FIG. 8 including the transverse or crosswise axis Y—Y of the operating table shown in FIG. 1.

FIG. 10 shows a section substantially along the line X—X in FIG. 8. There will be recognized the lamellae or plates 83 of the seat or pelvis rest member 80, the members 54, 54', 51 and 56, 56' of the supporting frame 50, the members 46, 46', 47, 48' as well as the recesses 29, 47' of the first housing member 45, the side walls 86, 86' and the bearing 87 provided for the bolt or bolt member 28 of the second housing member 85, the stand tube or pipe 16 of the standard or upright column 15 as well as the main bearing 20 arranged at the standard 15. The main bearing 20 is formed by two spaced apart bearing members 20', 20'', by a lug or bracket 21 and by a plate 21' mounted to the telescoped or telescopic tube 17. The bolt or bolt member 19 forming the crosswire or transverse axis Y—Y of the operating table 150 is journaled in the main bearing 20 as well as in two bearings 89 and 89' arranged at a distance from each other in the side walls 86, 86'. Furthermore, the partially shown piston-cylinder unit 23, 22 as well as the members 40', 34', 35', 41 and 42 of the first adjusting means, will be recognized in FIG. 10.

Figure 11:
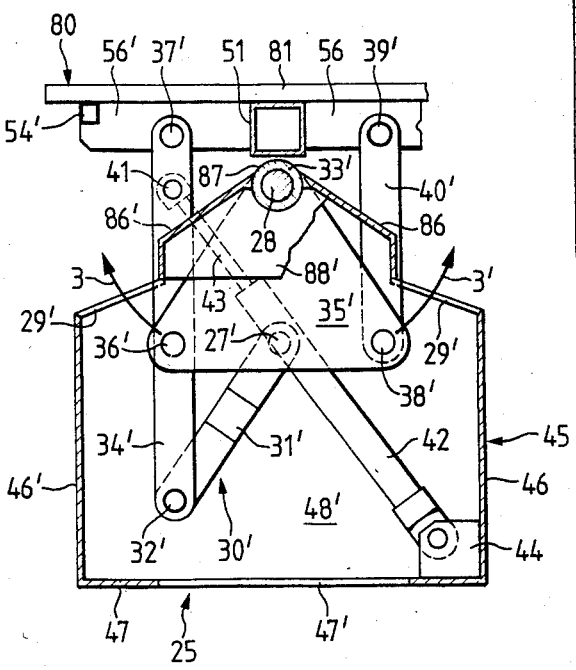
FIG. 11 is a section taken along the line XI—XI in FIG. 8 illustrating details of the second adjusting means or mechanism of the operating table shown in FIG. 1.

FIG. 11 shows a section substantially along the line XI—XI in FIG. 8. There will be recognized the lamella or plate 81 of the seat or pelvis rest member 80, the members 51, 54 and 56, 56' of the supporting frame 50, the members 46, 46', 47, 48' and the recesses 29' and 47' of the first housing member 45, the side walls 86, 86', the bearing 87 including the bolt 28, the rear wall 88' of the second housing member 85 which is partially shown broken away, the piston-cylinder unit 43, 42 operatively connected with the second parallel link or guide 34', as well as the parts of the other one of the first adjusting means or mechanism 30' arranged within the support 25. As already mentioned, the other first adjusting means or mechanism 30' is formed by the members 35', 40', 34' and 31' as well as by the pivot bearings 38', 39', 36', 37', 32' and 27' and is designed analogous to the one first adjusting means or mechanism 30 described hereinbefore with reference to FIGS. 8 and 9.

In comparison to known operating tables, the operating table 150 as described hereinbefore provides the possibility of pivoting, during an operation or surgery, the patient rest or support structure 100 including the supporting frame 50 in a direction transverse to the operating table 150 as shown in FIGS. 4 and 5 by parallel displacement of the first adjusting means or mechanism 30, 30' relative to the standard 15 in the direction of the arrows 3, 3', without thereby locally pivoting or shifting the operating site or spot OP.

Furthermore, by synchronizing the vertical lifting or lowering movement relative to the floor, as designated by the directional double-headed arrow 1 in FIG. 1, to a thrust or traction movement largely oriented transversely to the lifting or lowering movement and related to the standard 15, the patient rest 100 may be pivoted or tilted about the operating location or site OP in the longitudinal direction of the operating table 150 with extensive preservation of the site of the operating location or spot OP. The pivoting movement in the longitudinal direction of the operating table 150 is represented by the directional arrows 4, 4' in FIGS. 6 and 7.

By suitably controlling the members acting upon the first adjusting means or mechanism 30, 30' and upon the second adjusting means or mechanism 130, the further possibility is given to pivot the patient rest 100, with essentially preservation of the locally fixed operating site or location OP, simultaneously in the longitudinal as well as in the transverse direction of the operating table 150.

While there are shown and described present preferred embodiments of the invention, it is to be distinctly understood that the invention is not limited thereto, but may be otherwise variously embodied and practiced within the scope of the following claims.

Accordingly, what I claim is:

1. An operating table, in particular for microsurgery, comprising:

an elevationally adjustable standard;

a supporting frame carried by said standard;

a patient rest structure supported by said supporting frame;

first adjusting means for effecting a first pivoting movement of said patient rest structure in a direction oriented transversely with respect to said operating table;

second adjusting means for effecting a second pivoting movement of said patient rest structure in a direction oriented in the longitudinal direction of the operating table;

said patient rest structure being pivotable about a surgical operating location disposed substantially within a symmetry plane of said operating table;

said first and said second adjusting means being structured and arranged at said operating table so as to leave the site of said operating location largely unaffected when said first and second pivoting movements are carried out;

said standard having a substantially vertical axis;

said first adjusting means being structured to accomplish a compound translatory displacement thereof relative to said axis of said standard, in order to enable said patient rest structure including said supporting frame to be pivoted transversely with respect to said operating table;

said first adjusting means including at least one parallelogram linkage arrangement;

each said parallelogram linkage arrangement including:

a number of links;

a connecting element;

said number of links comprising first links arranged behind one another and each having two ends; and said first links each being connected to said supporting frame at one of said two ends thereof and to said connecting element at the other one of said two ends thereof.

2. The operating table as defined in claim 1, wherein:

said patient rest structure comprises a plurality of members;

said plurality of members defining a headrest member, a backrest member, a pelvis rest member and a leg rest member;

said backrest member being fixedly connected to said supporting frame;

said pelvis rest member comprising a number of lamellae articulated to each other; and means for enabling performance of infinitely adjustable raising and lowering movements of said lamellae together with said leg rest member relative to said backrest member.

3. The operating table as defined in claim 2, further including:

shoulder rest members arranged to each side of said backrest member of said patient rest structure; and said shoulder rest members being structured for adjustment and for being locked in position in a direction essentially transverse to a longitudinal axis of said operating table.

4. The operating table as defined in claim 2, further including:

means for mounting said headrest member at said supporting frame; and said headrest member being infinitely adjustable relative to said backrest member with respect to the elevational position thereof and with respect to the distance thereof from said backrest member.

5. The operating table as defined in claim 1, further including:

a main bearing provided for said standard for pivotably mounting said patient rest structure thereat; and said patient rest structure being pivotable in the longitudinal direction of said operating table with extensive preservation of the position of said operating location by synchronization of a vertically directed lifting or lowering movement relative to a floor supporting the operating table.

6. The operating table as defined in claim 5, wherein:

said second adjusting means synchronizes said lifting or lowering movements and said second pivoting movement;

a substantially housing-like support provided for said second adjusting means;

said second adjusting means comprising:

a first working piston and cylinder unit disposed in said housing-like support;

said main bearing being fixed to an upper end of said standard and having a lug;

a second working piston and cylinder unit arranged eccentrically with respect to said first working piston and cylinder unit;

said cylinder of said second piston and cylinder unit being journaled in said housing-like support at an inclination on the cylinder side thereof; and said second piston and cylinder unit acting upon said lug of said main bearing on the piston side thereof.

7. The operating table as defined in claim 6, wherein:

said housing-like support supports said second adjusting means, said supporting frame and said patient rest structure;

a bolt member operatively interconnecting said housing-like support with said main bearing;

said bolt member forming a transverse axis of said operating table;

said housing-like support including a floor member;

a recess provided in said floor member of said housing-like support; and said recess permitting said second pivoting movement of the patient rest structure in said longitudinal direction of said operating table with respect to said standard.

8. The operating table as defined in claim 1, wherein:

said first and second adjusting means being structured to be operated either individually or conjointly to effectuate the respective first and second pivoting movements of said patient rest structure in said transverse and/or longitudinal direction of said operating table.

9. An operating table, in particular for microsurgery, comprising:

an elevationally adjustable standard;

a supporting frame carried by said standard;

a patient rest structure supported by said supporting frame;

first adjusting means for effecting a first pivoting movement of said patient rest structure in a direction oriented transversely with respect to said operating table;

second adjusting means for effecting a second pivoting movement of said patient rest structure in a direction oriented in the longitudinal direction of the operating table;

said patient rest structure being pivotable about an operating location disposed substantially within a symmetry plane of said operating table;

said first and said second adjusting means being structured and arranged at said operating table so as to leave the site of said operating location largely unaffected when said first and second pivoting movements are carried out;

said standard having a substantially vertical axis;

said first adjusting means being structured to accomplish a compound translatory displacement thereof relative to said axis of said standard, in order to enable said patient rest structure including said supporting frame to be pivoted transversely with respect to said operating table;

said first adjusting means including at least one parallelogram linkage arrangement;

each said parallelogram linkage arrangement including:

a number of links;

a connecting element forming an equilateral triangle;

said number of links comprising first links arranged behind one another and each having two ends; and said first links each being connected to said supporting frame at one of said two ends thereof and to said connecting element at the other one of said two ends thereof.

10. The operating table as defined in claim 9, further including:

a substantially housing-like support;

two of said parallelogram linkage arrangements being provided;

said connecting elements of said first adjusting means being arranged to opposite sides of said standard and substantially symmetrically relative thereto;

a bolt operatively interconnecting said connecting elements;

said bolt substantially forming a longitudinal axis of said operating table;

drive means for accomplishing the pivoting of said patient rest structure transversely with respect to said operating table;

said drive means comprising at least one working piston and cylinder unit;

said at least one working piston and cylinder unit being pivotably mounted at said housing-like support on the cylinder side thereof; and said at least one working piston and cylinder unit acting upon one of said first links at the piston side thereof.

* * * * *

UNITED STATES PATENT AND TRADEMARK OFFICE

CERTIFICATE OF CORRECTION

PATENT NO. : 4,558,857

DATED : December 17, 1985

INVENTOR(S) : Rudolf HELLER

It is certified that error appears in the above—identified patent and that said Letters Patent is hereby corrected as shown below:

Column 3, line 37, please delete "bae" and insert --base--

Column 9, line 67, please delete "crosswire" and insert --crosswise--

Signed and Sealed this

*Fifteenth* Day of *April 1986*

[SEAL]

*Attest:*

DONALD J. QUIGG

*Attesting Officer*

*Commissioner of Patents and Trademarks*